United States Patent [19]

Platt

[11] 3,949,873

[45] Apr. 13, 1976

[54] CARDBOARD AND PAPER RECORD JACKET

[75] Inventor: Joseph Platt, Point Lookout, N.Y.

[73] Assignee: Imperial Paper Box Corporation, Brooklyn, N.Y.

[22] Filed: Nov. 20, 1974

[21] Appl. No.: 525,572

[52] U.S. Cl. ..... 206/311; 229/48 R; 229/40

[51] Int. Cl.[2] ..... B65J 85/30; B65J 5/42

[58] Field of Search ..... 206/311, 312, 309; 229/48 R, 40, 68 R

[56] References Cited

UNITED STATES PATENTS

| | | | |
|---|---|---|---|
| 3,061,086 | 10/1962 | Smiler | 206/312 |
| 3,301,467 | 1/1967 | Shore | 206/312 |
| 3,337,119 | 8/1967 | Bowers et al. | 206/312 |

FOREIGN PATENTS OR APPLICATIONS

| | | | |
|---|---|---|---|
| 973,285 | 10/1964 | United Kingdom | 206/312 |

*Primary Examiner*—William Price
*Assistant Examiner*—Douglas B. Farrow
*Attorney, Agent, or Firm*—McGlew and Tuttle

[57] ABSTRACT

A record jacket is formed of a paper sheet which is cut from a web which has been printed on one side or it is printed after it is formed into sheets. The paper sheet includes a first panel of lesser width than a second panel which includes a foldable second panel side flap extending along each side. The sheet is coated with an adhesive on the face opposite to the printed face and it is joined to a cardboard or similar paperboard back which has been cut and scored so as to form it with a first blank panel which is of less width than the first sheet panel, and a second blank panel with a foldable blank flap on each side which makes it slightly wider than the second sheet panel. The board is placed over the adhesive face of the sheet and the paper sheet flap and the cardboard flaps are folded over the top surface of the blank second panel so as to expose an uncovered edge of the board flap and a portion of the board flap which is covered by the sheet flap. Thereafter, the adhered first board panel and sheet panels are folded upon the second board and the wider sheet panels are adhered onto the uncovered edges of the board flap and also to a part of the covered portion of these flaps. The first panel fits between the two board flaps and does not overlap.

2 Claims, 13 Drawing Figures

CARDBOARD AND PAPER RECORD JACKET

FIELD AND BACKGROND OF THE INVENTION

This invention relates in general to the construction of cardboard and paper folders and, in particular, to a new and useful method and apparatus for forming folders of cardboard and paper particularly, record jackets, so as to provide an inexpensive jacket with an outer printed paper surface and with a minimum thickness.

DESCRIPTION OF THE PRIOR ART

At the present time, so-called record jackets are manufactured either from paperboard alone or by a combination of paperboard and paper. When the paperboard alone is employed, an expensive finish must be imparted to the board in order to condition the board for printing thereon. A disadvantage in the use of the board alone is that it is difficult to form the record jacket from the board alone and to effect the scoring of the board so as to precisely align, for example, the backbone or rear edge of the jacket which desirably contains an identifying printing thereon. When the jacket is made by combining a printed paper with a board, the known constructions have the disadvantage that it is difficult to adhere edge parts of the construction together because of the fact that the board is covered with the paper at all locations and, in addition, the known constructions create a jacket which has more than a double thickness of board and paper which is necessitated by the requirement of the interengagement of the edge parts or connecting flaps.

SUMMARY OF THE INVENTION

In accordance with the present invention, there is provided a simple method of forming a combined paperboard or cardboard with a printed paper sheet and to simply fold and score the cardboard so that it is cable of forming a precise backbone or spine which may be easily aligned with a printed sheet so as to define a precise edge or end face which may contain an indicia thereon for the record information when the record is stored in files. In accordance with a feature of the invention, both the paper sheet and the board are provided with a second panel, which is wider than the first. The second panel of the board has a flap which extends laterally outwardly beyond a similar flap of the sheet so that, when the sheet on the bottom is adhered to the board placed thereon, the flaps may be folded over so as to leave an uncovered flap edge of raw board. This uncovered flap edge may be easily sealed to the sheet first panel which is adhered to the first panel of the board and is wider than the first board panel so that, when the two panels are folded together by folding along an edge of the spine or backbone, the outwardly extending wider edge of the first panel sheet may be adhered to the raw board of the flaps of the second panel. In the preferred form, the sheet is made wide enough so that it may also become adhered to a portion of the flap of the second sheet panel which is folded over with the board flap. The folded-over board flap is made to a dimension such that it abuts against the edge of the first board panel edge so that there is no multiple thickness of board in the finished jacket which would require a large amount of stacking space.

In a similar manner, a so-called double jacket is formed by using a board blank with first and second board blank panels which are hinged together by an intermediate backbone or spine portion and which include first and second panel extensions from a common side edge of the first and second panels which form overlying panels. The first and second panels also have first and second flaps on their opposite edges which may be folded over the tops thereof and which are of a dimension such that they abut against the overlying panels. In this construction, the paper sheet which has been printed, is coated with adhesive on the face which does not contain the printing, and it is adhered to the first and second board panels and to the overlying panels and it extends in an verlying position completely over tops of the over-lying panels and the upturned flaps and a portion of the sheet which has been turned upwardly with the upturned flaps from the opposite edge so that the paper adheres to the raw board of the flaps and also to a portion of the upturned sheet of the opposite edge.

Accordingly, it is an objectt of the invention to provide an improved method for forming a record jacket of separate paperboard or cardboard and a paper sheet which may be printed and includes adhering the board to the paper sheet which has been coated with adhesive and folding up side flaps of the paper sheet and the board of one panel portion of each so as to position the folded up side flap so that it may be adhesively secured by a folded over sheet which is adhered to the other panel portion and which adhesively engages the raw board and positions the other panel so that it abuts the panel containing the flap.

A further object of the invention is to provide a record jacket construction which includes first and second principal panels and preferably a connecting spine therebetween and wherein each panel is made up of a first and second board panel which is adhered to first and second sheet panels and wherein one of said board and sheet panels includes inturned side flaps which abut against the edges of the other panel which is folded upon the one panel and wherein the sheet which is folded with the other panel upon the one panel and is adhered to the panel is also adhered to the uncovered edge of the folded over board and a portion of the folded over paper sheet.

A further object of the invention is to provide a double record jacket construction which includes a paper board blank having first and second panels interconnected by a backbone panel, each of said first and second panels including an additional side panels connected along a side edge thereof which are separated centrally by said backbone panel, each first and second panel also having a foldable flap along its opposite edge which may be folded over the top thereof in a position so as to abut the additional panel which is also folded along the top thereof, and wherein the panels are secured in position by a covering sheet which is folded over with the additional panels and engages over the raw flap and a portion of an upwardly turned edge of the sheet from the opposite end.

A further object of the invention is to provide a record jacket which is simple in design, rugged in construction, and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there are illustrated preferred embodiments of the invention.

DESCRIPTION OF THE PREFERRED EMBODIMENTS

Figure 1:
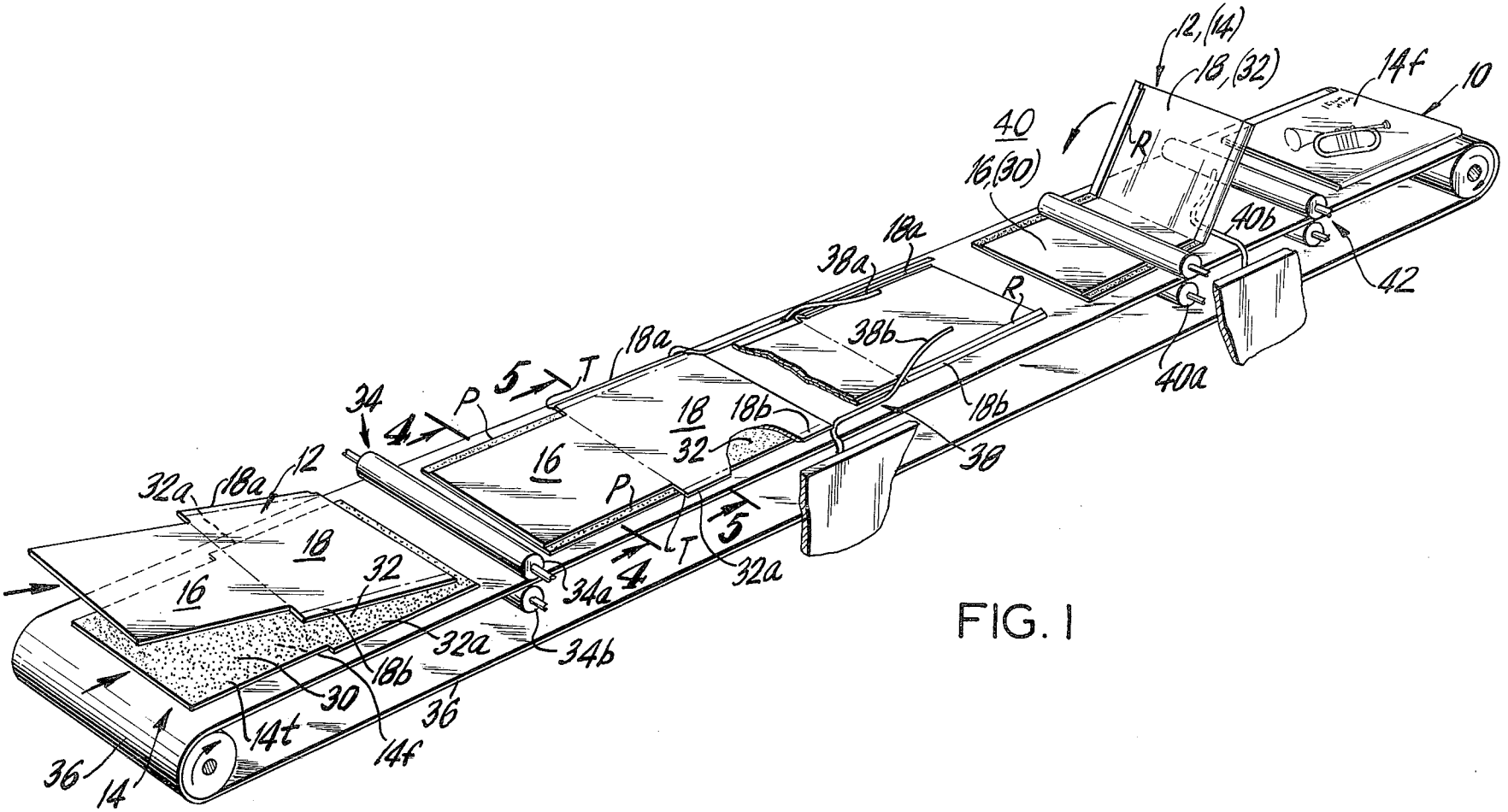
FIG. 1 is a schematic indication of an apparatus for forming a record jacket in accordance with the invention.
Figure 2:
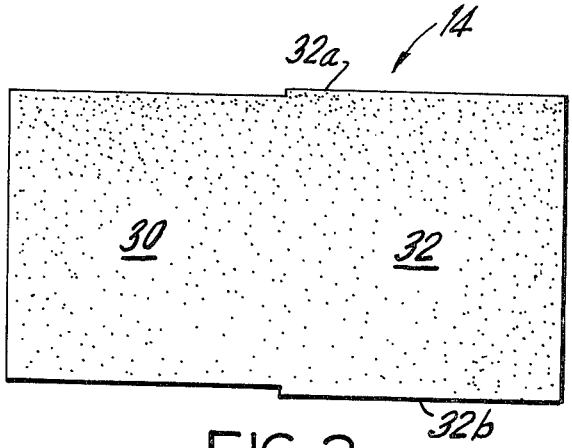
FIG. 2 is a top plan view of a printed paper blank.

Referring to the drawings in particular, the invention embodied therein, as indicated in FIGS. 1 to 8, comprises a method of forming a folder, such as a record jacket, generally designated 10, from a separate sheet of cardboard or paperboard 12 and a sheet of paper 14.

Figure 3:
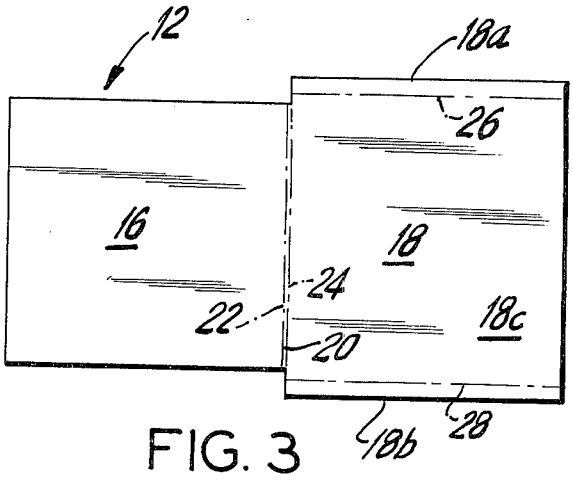
FIG. 3 is a top plan view of a paper or cardboard blank.
Figure 4:
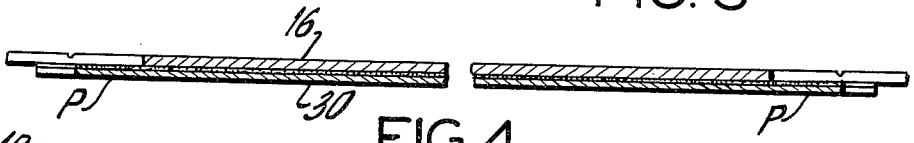
FIG. 4 is a section taken along the line 4—4 of FIG. 1.
Figure 5:
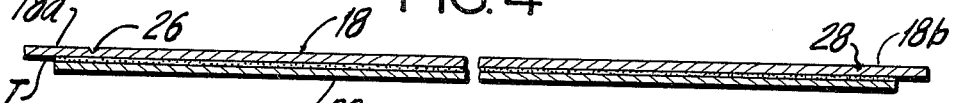
FIG. 5 is a section taken along the line 5—5 of FIG. 1.
Figure 6:
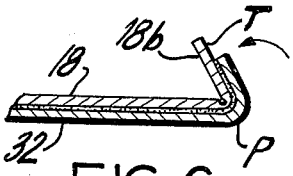
FIG. 6 is a partial view, similar to FIG. 5, indicating the manner of folding over the side flaps.
Figure 7:
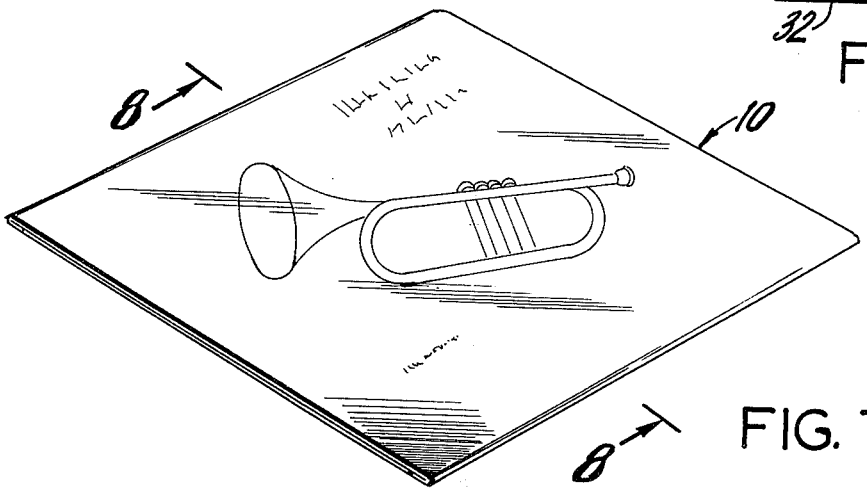
FIG. 7 is a front end perspective view of a record jacket constructed in accordance with the invention.
Figure 8:
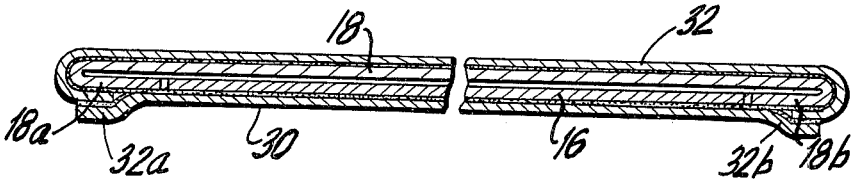
FIG. 8 is a section taken along the line 8—8 of FIG. 7.
Figure 9:
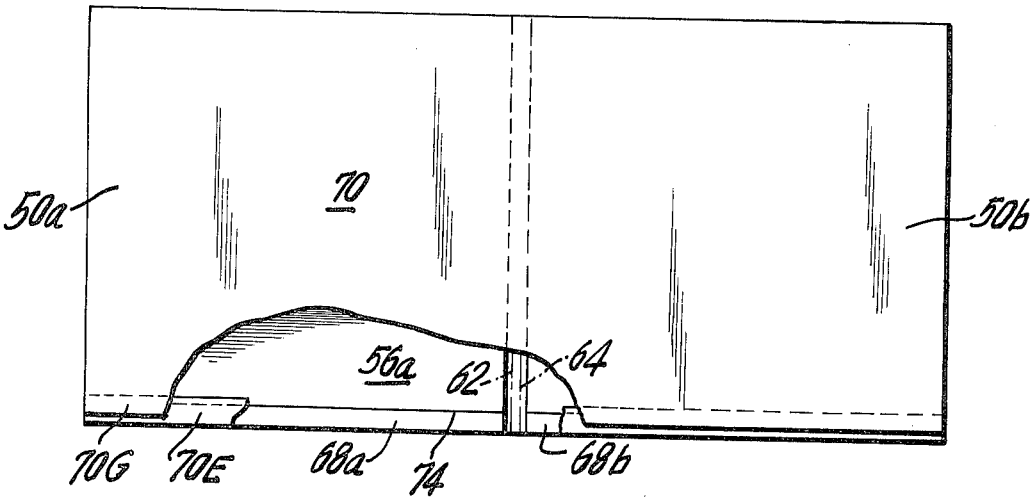
FIG. 9 is a top plan view with a portion of the parts removed showing a double record jacket constructed in accordance with the invention.
Figure 10:
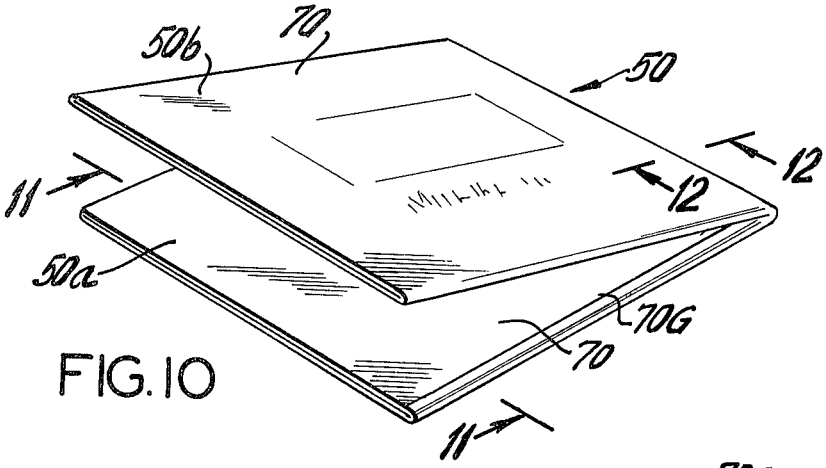
FIG. 10 is a front end perspective view of the double record jacket constructed in accordance with the invention.

In accordance with the invention, paper 14 is first printed on its underface 14*f* and it is moved with its imprinted surface 14*f* downwardly while its opposite top side 14*t* is moved into association with means for applying an adhesive coating thereon over the entire top surface. The cardboard or paperboard blank 12, as best indicated in FIG. 3, includes a first blank panel 16 and a second blank panel 18 which are pivotally connected together either directly or through a central bank panel 20 which is referred to generally as a spine or backbone. Spine or backbone 20 is formed between score lines 22 and 24 which extend the width of the first panel 16. By forming the spine 20 separately in this manner, it is possible to make it of any desired thickness merely by adjusting the spacing between the score lines 22 and 24. The second panel 18 also includes second panel flap portions 18*a* and 18*b* which are demarcated from a central panel area 18*c* by score lines 26 and 28, respectively.

The paper sheet 14 is cut from a web to form a first panel 30 and a second panel 32 which is wider than panel 30. The widened portion forms paper flaps 32*a* and 32*b* at respective sides which project outwardly from panel 30.

After the paperboard blank 12 and the paper sheet 14 are formed from a web, paper sheet 14 is fed into association with means for coating it with adhesive and is then passed beneath the board blank 12, as indicated in FIG. 1 and the two parts are adhesively secured together by passing them between presser means, generally designated 34, which, as schematically indicated, comprises an upper roller 34*a* and a lower roller 34*b.* The combined sheet is moved along by conveyor means, such as an endless belt conveyor 36, and after the combined board 12 and paper 14 pass through the presser means 34, they are adhesively connected together, except in areas P on each side of the first paper panel 30 and areas T on the underside of blank panels 18*a* and 18*b.*

The combined blanks 12 and 14 are then fed past side flap folding means, generally designated 38, which may, for example, comprise folding plows 38*a* and 38*b.* Plows 38*a* and 38*b* turn over the blank flaps 18*a* and 18*b* and, in so doing, turn over the paper flaps 32*a* and 32*b* which are adhered thereto. In so doing, this leaves a portion R of the flaps 18*a* and 18*b* which is not covered by the paper blank 14.

Thereupon, the combined blank is moved into association with panel folding means, generally designated 40, which are effective to raise the combined panels 18 and 32 and, as schematically indicated, they comprise a roller set 40*a* and a deflecting device 40*b.* The combined panels 18 and 32 are deflected over until they fall down on the top of the combined panels 16 and 30 and are moved together between second presser means 42 which press the two combined panels together to seal them together. In so doing, the adhesive on the portion P of the paper sheet which is not covered by panel 16 adheres to the raw cardboard or uncovered cardboard at the location R and also adheres to the portion of the flap 18a which is covered by the paper of flaps 32*a* and 32*b,* respectively. The thickness of the board 16 thus does not add to the thickness of the infolded flaps 18*a* and 18*b,* but rather lies in between the edges of these flaps so that the finished record jacket 10 will have a minimum thickness, which will not be increased by more than two layers of cardboard.

In the embodiment illustrated in FIGS. 9 to 12, there is provided a so-called double record jacket construction, designated 50. This double record jacket 50 includes first and second sections 50*a* and 50*b* which are hinged together at a backbone or spine 52.

The double record jacket 50 is made from a blank, generally designated 54, which may be of cardboard, paperboard, or other similar material, and it comprises first and second main blank panels 56 and 58 having secondary side flaps 56*a* and 58*a* pivotally connected thereto along a side edge. A double score line 60 separates the main panels 56 and 58 from their flaps 56*a* and 58*a.* Double score lines 62 and 64 demarcate panels 56 and 58 and define the spine 52 therebetween. A slot 66 separates the two auxiliary flaps 56*a* and 58*a.* Each panel 56 and 58 carries a sealing flap 68*a* and 68*b.*

Figure 11:
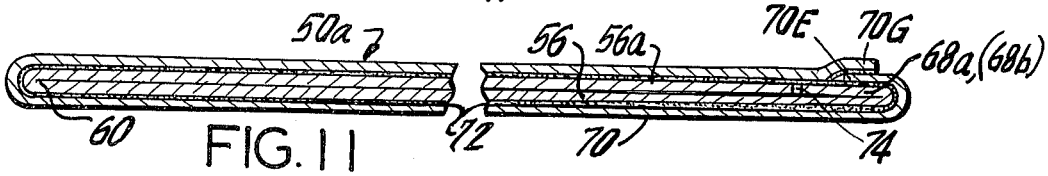
FIG. 11 is a section taken along the line 11—11 of FIG. 10.
Figure 12:
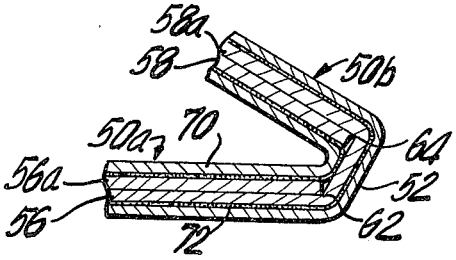
FIG. 12 is a section taken along the line 12—12 of FIG. 10.
Figure 13:
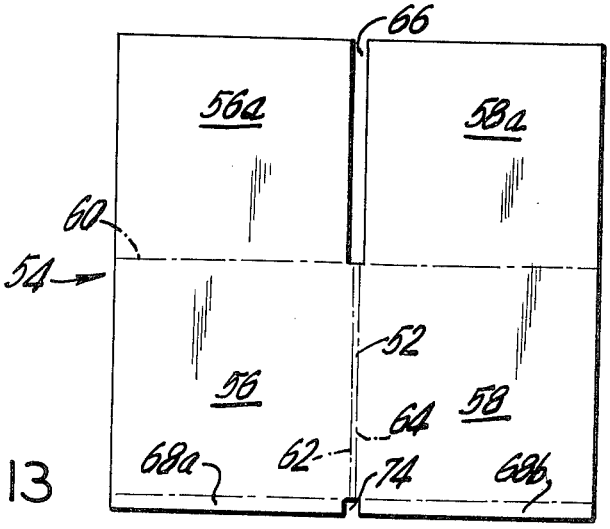
FIG. 13 is a top plan view of the cardboard blank for the record jacket of FIG. 10.

In order to finish the double record jacket 50, a single sheet of paper 70 is coated on one surface with an adhesive 72 after the opposite surface is printed in a suitable form. After paper 70 is secured to the main flaps 56 and 58 and the associated auxiliary flaps 56*a* and 58*a* and the connecting flaps 68*a* and 68*b,* the main flaps 56 and 58 are folded along the score line 60 in respect to the auxiliary flaaps 56*a* and 58*a,* and the additional flaps 68*a* and 68*b* are bent over upon the opposite surface (the surface not shown in FIG. 13) where it abuts against the edge of the flaps 56*a* or 58*a* as the case may be. Paper 70 is large enough so that an edge thereof 70E overlaps the joint 74 between flaps 68*a* and 68*b* and the associated auxiliary panels 56*a* and 58*a*. The opposite side of paper sheet 70 includes an overlapping edge 70G which overlaps the edge 70E, as shown in FIG. 11. At the interior of spine 52, the panels 56*a* and 58*a* are spaced apart, but the paper sheet 70 bridges the connecting gap which is formed by the slot 66.

While specific embodiments of the invention have been shown and described in detail to illustrate the application of the principles of the invention, it will be understood that the invention may be embodied otherwise without departing from such principles.

What is claimed is:

1. A record jacket construction, comprising an inner cardboard layer having a first panel folded into juxtaposition with a second panel, each panel having an outer edge and two side edges, a respective side flap extending along each side edge of said second panel, folded backwardly over said second panel, and having an outer edge arranged in substantially coplanar abutment with each side edge of said first panel, said first and second panels defining a record receiving pocket therebetween opening adjacent the outer edges of said first and second panels, and a printed paper cover sheet having first and second panels and an interior adhesive surface adhered to said blank first and second panels, and having respective paper second panel flaps which overlie but are not as wide as said blank second panel flaps, said paper first panel overlying said blank first panel and extending outwardly from each side edge thereof, and overlying and adhered to at least a portion of each blank second panel flap and a portion of each paper second panel flap.

2. A record jacket construction, according to claim 1, including an intermediate backbone forming panel between said first and second panels being foldable in respect to said first and second panels and forming a backbone of said record jacket.

* * * * *